United States Patent [19]

Freshwater et al.

[11] Patent Number: 4,487,471

[45] Date of Patent: Dec. 11, 1984

[54] SOCKET CONNECTOR

[75] Inventors: Lane A. Freshwater, Lino Lakes; Eugene E. Moynagh, Jr., Afton, both of Minn.

[73] Assignee: Minnesota Mining and Manufacturing Company, St. Paul, Minn.

[21] Appl. No.: 456,533

[22] Filed: Jan. 6, 1983

[51] Int. Cl.[3] ..... H01R 13/12; H01R 13/38

[52] U.S. Cl. ..... 339/99 R; 339/258 P

[58] Field of Search ..... 339/97 R, 97 P, 99 R, 339/205, 258 R, 258 F, 258 P

[56] References Cited

U.S. PATENT DOCUMENTS 3,034,093 5/1962 Blain ..... 339/258 R 3,808,578 4/1974 Hansen ..... 339/258 P

FOREIGN PATENT DOCUMENTS 7315491 11/1973 Netherlands ..... 339/258 R

*Primary Examiner*—Joseph H. McGlynn

*Attorney, Agent, or Firm*—Donald M. Sell; James A. Smith; Terryl K. Qualey

[57] ABSTRACT

A socket connector having an insulating body containing a plurality of contact elements in which each of the contact elements is stamped from sheet metal and has a connecting end and a pin contacting end. The pin contacting end of each contact element has a main body portion with a flat pin guiding and contacting surface and a pair of pin contact areas spaced from and facing the pin guiding and contacting surface and defined on a pair of spring arms that are cantilevered in opposite directions from a central bridge. The bridge is connected along one edge to a connecting link extending between the main body portion and the bridge and having a greater area of connection to the main body portion than to the bridge.

6 Claims, 7 Drawing Figures

SOCKET CONNECTOR

FIELD OF THE INVENTION

The present invention relates to a socket connector in which the contact elements have multiple pin contacting areas.

BACKGROUND OF THE INVENTION

It has long been recognized that in socket connectors it is preferable that the contact element have multiple wiping surfaces to resiliently press against the opposite sides of a pin and provide multiple electrical contacts to the pin. Socket connectors of this type are illustrated in U.S. Pat. Nos. 3,917,375; 3,966,295; 3,955,869; 4,040,705; 4,073,560; 4,094,566; 4,230,387; and 4,232,927 and Japanese Patent Publication No. JA 52-3188 published Jan. 11, 1977. When resistance to removal of the socket connector has been desired, for example where vibration is a problem, a latching mechanism between the socket connector and the part containing the pins has been provided such as that disclosed in U.S. Pat. No. 4,230,387.

SUMMARY OF THE INVENTION

The present invention provides a socket connector comprising an insulating body having a plurality of contact element apertures therethrough from a connecting surface to an opposed external surface, and a plurality of contact elements, one in each of said contact element apertures. Each of the contact elements has a connecting end extending from the connecting surface of the insulating body and a pin contacting end within a contact element aperture. The pin contacting end has a main body portion with a pin guiding and contacting surface and a pair of pin contact areas spaced from and facing the pin guiding and contacting surface and spaced from each other longitudinally with respect to the insertion of the pin into the contact element aperture. The pin contact areas are defined on a pair of spring arms facing the flat pin guiding and contacting surface and are cantilevered in opposite directions from a bridge. The bridge is connected along one edge to a connecting link extending between the main body portion and the bridge and it has a greater area of connection to the main body portion than to the bridge. The two spring arms and the pin guiding and contacting surface provide three contacts to a pin, the second spring arm engaging the pin near the end of its insertion into the socket connector and approximately doubling the pin contacting force so that vibration can be withstood without a latching mechanism.

THE DRAWING

Figure 1:
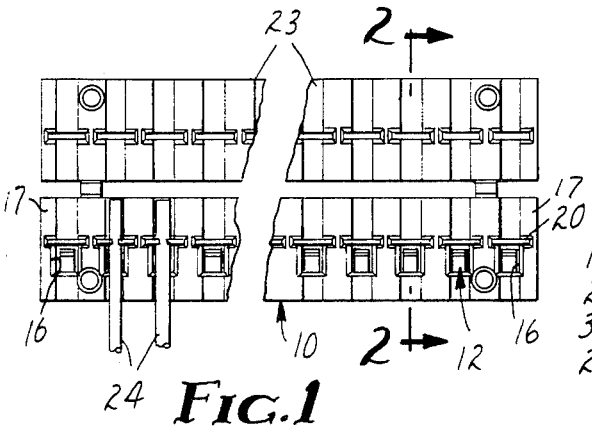
FIG. 1 is a top view of a socket connector constructed in accordance with the present invention with the cover in the open position.
Figure 2:
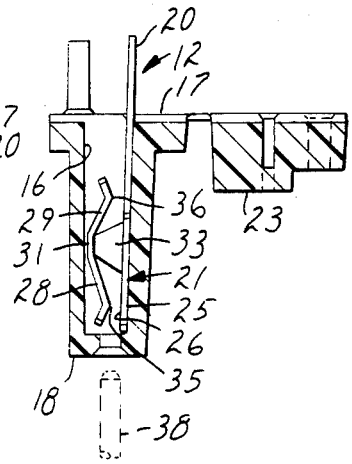
FIG. 2 is a cross-sectional view of the connector taken generally along line 2—2 of FIG. 1.
Figure 3:
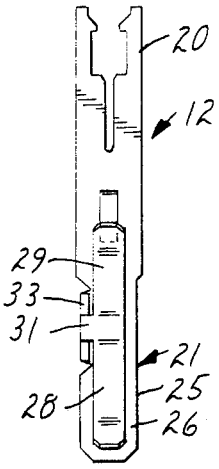
FIG. 3 is a front elevation view of one of the contact elements in the connector of FIGS. 1 and 2.
Figure 4:
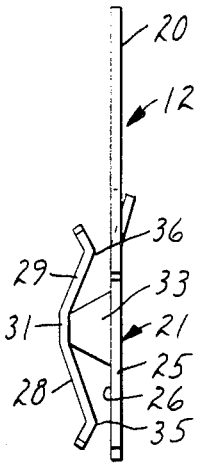
FIG. 4 is a side elevation view of the contact element of FIG. 3.
Figure 5:
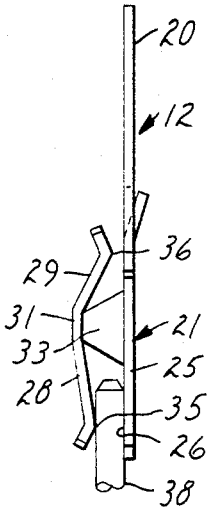
FIG. 5 is a side elevation view of the contact element of FIG. 3 with a pin partially inserted into it.
Figure 6:
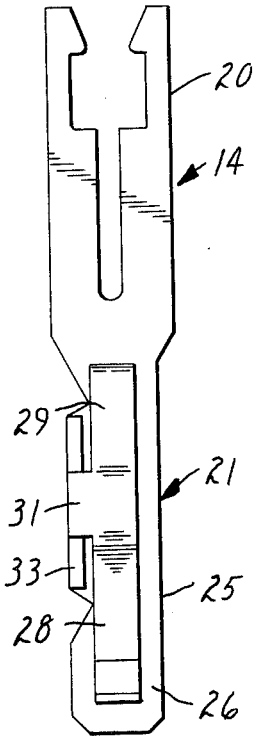
FIG. 6 is a front elevation view of a second embodiment of a contact element for use in the connector.
Figure 7:
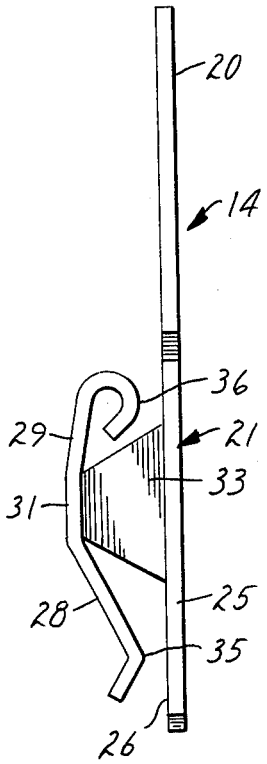
FIG. 7 is a side elevation view of the contact element of FIG. 6.

The socket connector of the present invention comprises an insulating body 10 and a plurality of contact elements 12 (illustrated in the embodiment of FIGS. 1–5) or 14 (illustrated in FIGS. 6 and 7). The two forms of contact elements 12 and 14 illustrated are very similar and like numerals are used to designate like parts.

The insulating body 10 has a plurality of contact element apertures 16 extending therethrough from a connecting surface 17 to an opposed external surface 18. A contact element 12 or 14 is retained in each of the contact element apertures 16.

Each contact element 12 or 14 is stamped from sheet metal and has a connecting end 20 extending from the connecting surface 17 of the body and a pin contacting end 21 within the contact element aperture 16. In the illustrated embodiments the connecting end 20 is a bifurcate flat plate insulation displacement wire contact which will cut through the insulation on a wire 24 and make electrical connection to the conductive core upon being forced into the slot formed in the contact. An insulating cover 23 is provided with slots to receive the connecting ends 20 of the contact elements so that wires 24 will be pressed into the slots in the wire connecting ends 20 of the contact elements upon pressing the cover 23 toward the body 10.

The pin contacting end 21 of each contact element 12 or 14 has a main body portion 25 with a flat pin guiding and contacting surface 26, a pair of spring arms 28 and 29 facing the surface 26 and joined at a bridge 31, and a connecting link 33 joining the main body portion 25 and the bridge 31. A pair of pin contact areas 35 and 36 are defined one on each of the spring arms 28 and 29, respectively, spaced from and facing the flat pin guiding and contacting surface 26 and spaced from each other longitudinally with respect to the insertion of a pin 38 into the contact element aperture 16.

The spring arms 28 and 29 are cantilevered in opposite directions from the bridge 31. In both embodiments the lower spring arm 28 extends from the bridge 31 at an angle toward the pin guiding and contacting surface 26 and adjacent its end is turned outward from the pin guiding and contacting surface and the pin contact area 35 is defined at the bend in the spring arm 28. In the embodiment of FIGS. 1–5, the upper spring arm 29 likewise extends away from the bridge 31 at an angle toward the pin guiding and contacting surface 26 and adjacent its end is turned outward away from the pin guiding and contacting surface and the pin contact area 36 is defined at the bend in the spring arm 29. In the second embodiment illustrated in FIGS. 6 and 7, the upper spring arm 29 extends away from the bridge 31 and is then curled back upon itself to define the pin contact area 36 thereon.

The connecting link 33 has a greater area of connection to the main body portion 25 than to the bridge 31, in the illustrated embodiment linearly decreasing in cross-section from the main body portion 25 to the bridge 31. And, the bridge 31 is connected along one edge to the connecting link 33. The tapered connecting link 33 assures stability of the main body portion 25 and yet permits twisting or pivoting of the bridge 31 in response to a pin being inserted between the pin guiding and contacting surface 26 and the lower spring arm 28.

The twisting or pivoting of the bridge 31 upon engagement between the lower spring arm 28 and a pin 38 moves the upper spring arm 29 toward the pin guiding and contacting surface 26 as illustrated in FIG. 5. Thus, when the pin 38 engages the upper spring arm 29, force is applied tending to twist the bridge 31 back to its original position applying greater force to the lower spring arm 28 and provides a third pin contact point at the upper pin contact area 36. It has been found that with the design illustrated in FIGS. 1–5 with the upper spring arm 29 having a length approximately 5/6 that of the lower spring arm 28, the force when the pin engages the upper spring arm 29 is approximately twice the force of the pin engaging the lower spring arm 28 only. This significant increase in force during the small distance of travel necessary to engage the upper spring arm has made it feasible to make a socket connector without any additional latching system for use even where vibration may be a problem. Additionally, the three point contact with the high engagement force achieved upon complete pin insertion provides stability in the connection areas to minimize fretting inducing movements.

In one specific embodiment, a socket connector was constructed as illustrated in FIGS. 1–5 with six contact elements 12 on 0.156 inch (0.396 cm.) centers for connecting to 0.045 inch (0.114 cm.) pins. The contact elements were stamped out of 0.0150 inch (0.0381 cm.) thick CA 770 spring hard sheet metal, a copper-nickel alloy. The bridge 31 was 0.040 inch (0.102 cm.) in length. From the bridge to the bend in the lower spring arm 28 was 0.125 inch (0.318 cm.), from the bridge to the bend in the upper spring arm 29 was 0.100 inch (0.254 cm.) and from the bend in each spring arm to its end was 0.040 inch (0.102 cm.), all of these distances being measured parallel to the main body portion 25. The bridge 31 and the spring arms 28 and 29 had a width of 0.053 inch (0.135 cm.). The pin contact areas 35 and 36 on the spring arms 28 and 29 were spaced 0.035 inch (0.0889 cm.) from the pin guiding and contacting surface 26. The connecting link 33 had a length of 0.070 inch (0.178 cm.) between the main body portion 25 and the bridge 31 and it had a width at the main body portion of 0.120 inch (0.305 cm.) and a width at the bridge of 0.040 inch (0.102 cm.), the same as the length of the bridge. This connector was tested on square pins and found to require a force of 4 to 5 pounds (18 to 22 newtons) to move the connector onto the pins when the lower spring arms 28 were engaged which increased to 8 to 10 pounds (36 to 44 newtons) upon engagement of the upper spring arms 29.

We claim:

1. A socket connector comprising:

an insulating body having a plurality of contact element apertures therethrough from a connecting surface to an opposed external surface, and a plurality of contact elements, one in each of said contact element apertures, each said contact element being stamped from sheet metal and having a connecting end extending from said connecting surface and a pin contacting end within a said contact element aperture, said pin contacting end having a main body portion with a pin guiding and contacting surface and a pair of pin contact areas spaced from and facing said pin guiding and contacting surface and spaced from each other longitudinally with respect to the insertion of a pin into the contact element aperture, said pin contact areas being defined on a pair of spring arms facing said pin guiding and contacting surface and cantilevered in opposite directions from a bridge, said bridge being connected along one edge to a connecting link extending between said main body portion and said bridge and having a greater area of connection to said main body portion than to said bridge.

2. The socket connector of claim 1 wherein said connecting link of each said contact element has a linearly decreasing cross-section from said main body portion to said bridge.

3. The socket connector of claim 1 wherein said connecting end of each of said contact elements is a bifurcate flat plate insulation displacement wire contact.

4. The socket connector of claim 1 wherein for each of said contact elements the spring arm nearest said external surface of said body extends from said bridge at an angle toward said pin guiding and contacting surface and adjacent its end is turned outward away from said pin guiding and contacting surface.

5. The socket connector of claim 4 wherein each of said spring arm extends from said bridge at an angle toward said guiding and contacting surface and adjacent its end is turned outward away from said pin guiding and contacting surface.

6. The socket connector of claim 4 wherein the spring arm farthest from said external surface of said body extends away from said bridge and is then curled back upon itself to define said pin contact area.

* * * * *